US006126468A

United States Patent [19]

Matsushita et al.

[11] Patent Number: 6,126,468

[45] **Date of Patent: *Oct. 3, 2000**

[54] WATER-PROOF ELECTRICAL CONNECTOR WITH SEALING MEMBER ENGAGING RETAINING MEMBER

[75] Inventors: Yasuo Matsushita; Kazunori Yamashita; Mitsuhiro Fujitani, all of Yokkaichi-City, Japan

[73] Assignee: Sumitomo Wiring Systems, Ltd., Yokkaichi, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/008,657

[22] Filed: Jan. 16, 1998

[30] Foreign Application Priority Data

Jan. 24, 1997 [JP] Japan ..... 9-011599

[51] Int. Cl.[7] ..... H01R 13/52

[52] U.S. Cl. ..... 439/271

[58] Field of Search ..... 439/271, 272

[56] References Cited

U.S. PATENT DOCUMENTS 5,389,005 2/1995 Kodama ..... 439/272

5,498,170 3/1996 Tanaka ..... 439/271

FOREIGN PATENT DOCUMENTS 6-46067 11/1994 Japan .

*Primary Examiner*—Steven L. Stephan
*Assistant Examiner*—Barry M. L. Standig
*Attorney, Agent, or Firm*—Greenblum & Bernstein

[57] ABSTRACT

Retaining members are formed separately from a female connector housing and can be installed on the female connector housing. A sealing member is installed within the female connector housing prior to the installation of the retaining members. The sealing member includes protrusions having retaining portions, which protrusions are inserted into guide channels of the female connector housing without bending. Then, the retaining members are installed on the female connector housing, and two protrusions of the retaining members engage with the retaining portions from opposite sides, whereby the sealing member is retained against removal. When the sealing members are installed, the protrusions and retaining portions are not elastically deformed, and therefore resistance during installation is reduced, and the installation can be easily carried out.

10 Claims, 7 Drawing Sheets

WATER-PROOF ELECTRICAL CONNECTOR WITH SEALING MEMBER ENGAGING RETAINING MEMBER

BACKGROUND OF THE INVENTION

1. Field of the Invention

The present invention relates to a water-proof connector, and particularly relates to an improvement in the mounting structure of a sealing member for effecting the water-proofing.

2. Description of Background Information

A water-proof connector is known in the prior art as depicted in FIGS. 8–10. The connector is made water-proof by installing a sealing member in one part of a connector. As shown in FIG. 8, the connector includes a male connector 1, a female connector 2 and a sealing member 3. The sealing member 3 is formed as a ring-type sealing main body 3A and includes an installing protrusion 3B which protrudes from the sealing main body 3A as shown in FIG. 10. The sealing main body 3A is installed by fitting the installing protrusion 3B in an installation hole 2A of the female connector 2. When the male connector 1 is fitted within the female connector 2, a hood part 1A of the male connector is fitted in the sealing main body 3A.

Accordingly, the sealing member 3 is squeezed between two connectors 1 and 2 as shown in FIG. 9. Therefore, the space between the two connectors 1 and 2 can be made water-proof.

In a water-proof connector using the above-mentioned sealing member 3, it is necessary to prevent the sealing member 3 from being removed when the two connectors 1 and 2 are separated. Therefore, as a conventional means for preventing the sealing member 3 from being removed, an umbrella-type stop 3C is formed at the end of the installing protrusion 3B, and the stop 3C is installed by forcibly inserting the stop 3C into the installation hole 2A. As shown in FIG. 9, the removal of the sealing member 3 is prevented by hooking the rim of the stop 3C in the hole rim of the installation hole 2A.

However, the insertion of the stop 3C into the installation hole 2A causes an elastic bending of protrusion 3B, which results in a great resistance to insertion. Therefore, a sealing member for a water-proof connector having an easier operation with less resistance during installation has been desired.

The present invention has been created to obviate the problems described above, and the purpose is to provide a water-proof connector by which the installation of a sealing member can be easily carried out.

SUMMARY OF THE INVENTION

A water-proof connector is disclosed wherein the removal of a sealing member from one connector housing is regulated by retaining members which are installed on one connector housing. The retaining members have retaining portions which are inserted into guide channels in the connector housing. The retaining members are formed separately from the fore-mentioned one connector housing and able to be installed in openings in the one connector housing.

The retaining portions, which engage with the retaining members, are formed on the sealing member, and the fore-mentioned guide channels for inserting the retaining portions to a position for engaging with the retaining members are formed in the one connector housing of the water-proof connector. The sealing member is installed in one connector housing of a pair of connector housings which can be fitted together, and the engaging parts of the two connector housings are designed to be sealed by the sealing member.

In one embodiment of the invention, the retaining members have hooks that cooperate with the one connector housing and can be installed regardless of orientation as long as the hooks on the retaining members align with removal stopping protrusions on the connector housing.

In another embodiment of the invention, the retaining portions are formed on protrusions on the sealing members so as to extend perpendicularly to the removal direction of the sealing members. The two protrusions formed on the retaining members abut against both sides of the retaining portions in a manner to prevent movement in both the installation and removal direction.

According to another aspect of the present invention, stops are formed in the one connector housing, and the retaining members are engaged by the retaining members in the normal position of installation.

The sealing member is installed before the retaining members are installed, and the retaining portions of the sealing member are inserted in the guide channels without significant bending at this time. Then, the retaining members are installed, engaged with the retaining portions, and thus the sealing members are retained against movement. When the sealing member, according to the present invention is installed, resistance to the installation is reduced by a significant amount such that elastic bending of the protrusions does not take place.

The retaining members are installed on the one connector housing by engaging hooks on the retaining members with portions of the connector housing, and the sealing members are precluded from removal by the protrusions on the retaining members engaging with the protrusions on the sealing members. Since the hooks and the protrusions are symmetrically formed on opposite sides of the retaining members, they can be installed on the connector housing regardless of orientation as long as the hooks are aligned with the removal stopping protrusions on the connector housing. This allows the installation of the retaining members on the one connector housing to be carried out by an automatic machine.

When the sealing member is shifted toward the removal direction, the retaining portions are obliquely deformed rearwardly by engagement of the base edge part of the retaining portions on the sealing main body at the fore side, but since the retaining portions are engaged at both sides by the protrusions, deformation is controlled. Thus, since the retaining portions are slightly spaced from the retaining members, the reliability of the removal regulating function is improved.

When there is a tendency of the retaining members to be excessively displaced beyond the normal installation position, that displacement of the retaining members is regulated by abutment of protrusions on the retaining member with stops formed on the housing. The retaining members are prevented from pushing against the sealing members from pushing, and thus, excessive bending of the sealing members by the retaining members during installation is prevented.

BRIEF DESCRIPTION OF THE DRAWING

The above and other features and advantages of the present invention will be is made apparent from the following description of the preferred embodiments, given as non-limiting examples with reference to the accompanying drawings, in which.

DETAILED DESCRIPTION OF THE PREFERRED EMBODIMENTS

The first embodiment of the present invention is illustrated below, referring to FIG. 1 to FIG. 7.

Figure 8:
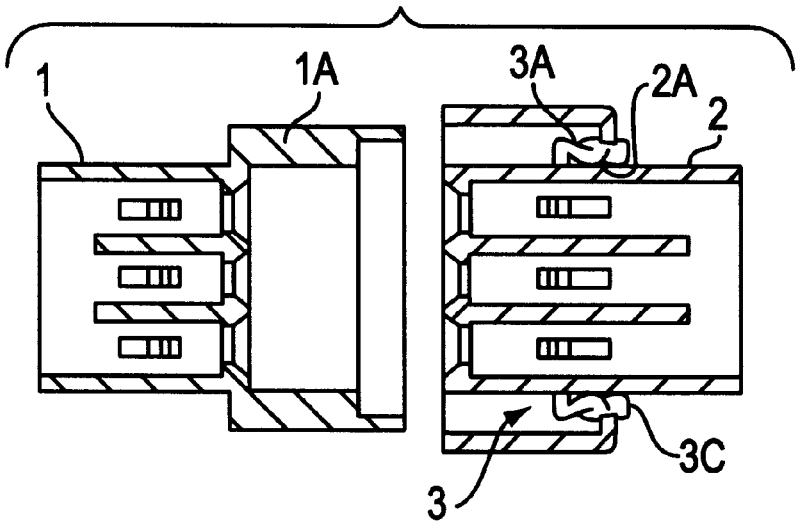
FIG. 8 (PRIOR ART)
FIG. 8 is a cross-sectional view of a prior art water-proof connector, depicting a male portion, a female housing, and a sealing member.
Figure 9:
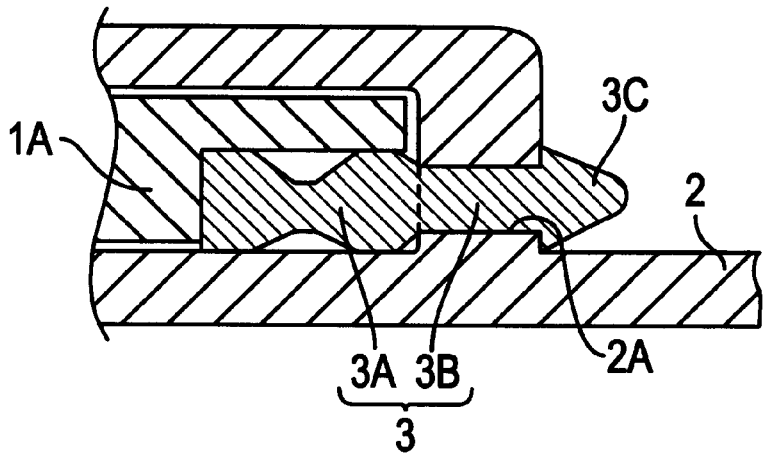
FIG. 9 (PRIOR ART)
FIG. 9 is an enlarged partial cross-sectional depicting the installation of a prior art sealing member.
Figure 10:
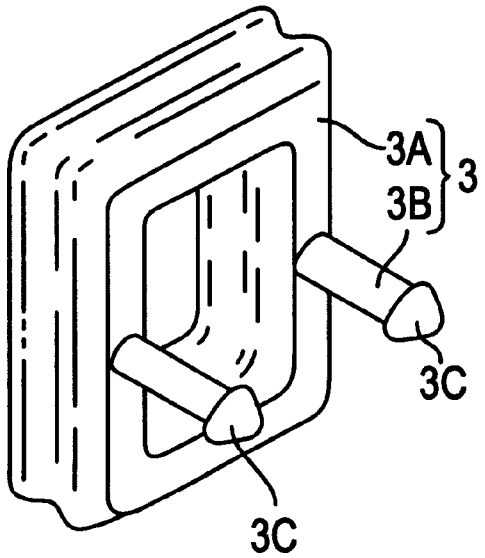
FIG. 10 (PRIOR ART)
FIG. 10 is a perspective view of the sealing member of a prior art water-proof connector.

The water-proof connector of the preferred embodiment includes a female connector housing 10, a male connector housing (not shown in FIGS. 1–7, similar to that shown in Prior Art FIGS. 8–10) to be fitted within the female connector housing 10, a sealing member 20 installed within the female connector housing 10, and retaining members 30 installed on the female connector housing 10.

The female connector housing 10 has a housing main body 11 and a guide pipe part 12 surrounding the housing main body 11. When the female connector housing 10 is fitted with the male connector housing, a hood part (not shown in the figures) of the male connector housing is designed to be fitted in the housing main body 11 while being guided to an inner end of the guide pipe part 12. A gap (similar to that shown in Prior Art FIG; 9 between hood part 1A and female connector 2 in the area of the main body 3A of the sealing connector 3) between the inner circle of the hood part and the outer circle of the housing main body 11 is water-proofed by the sealing member 20. The sealing member 20 is installed within the female connector housing 10.

Figure 1:
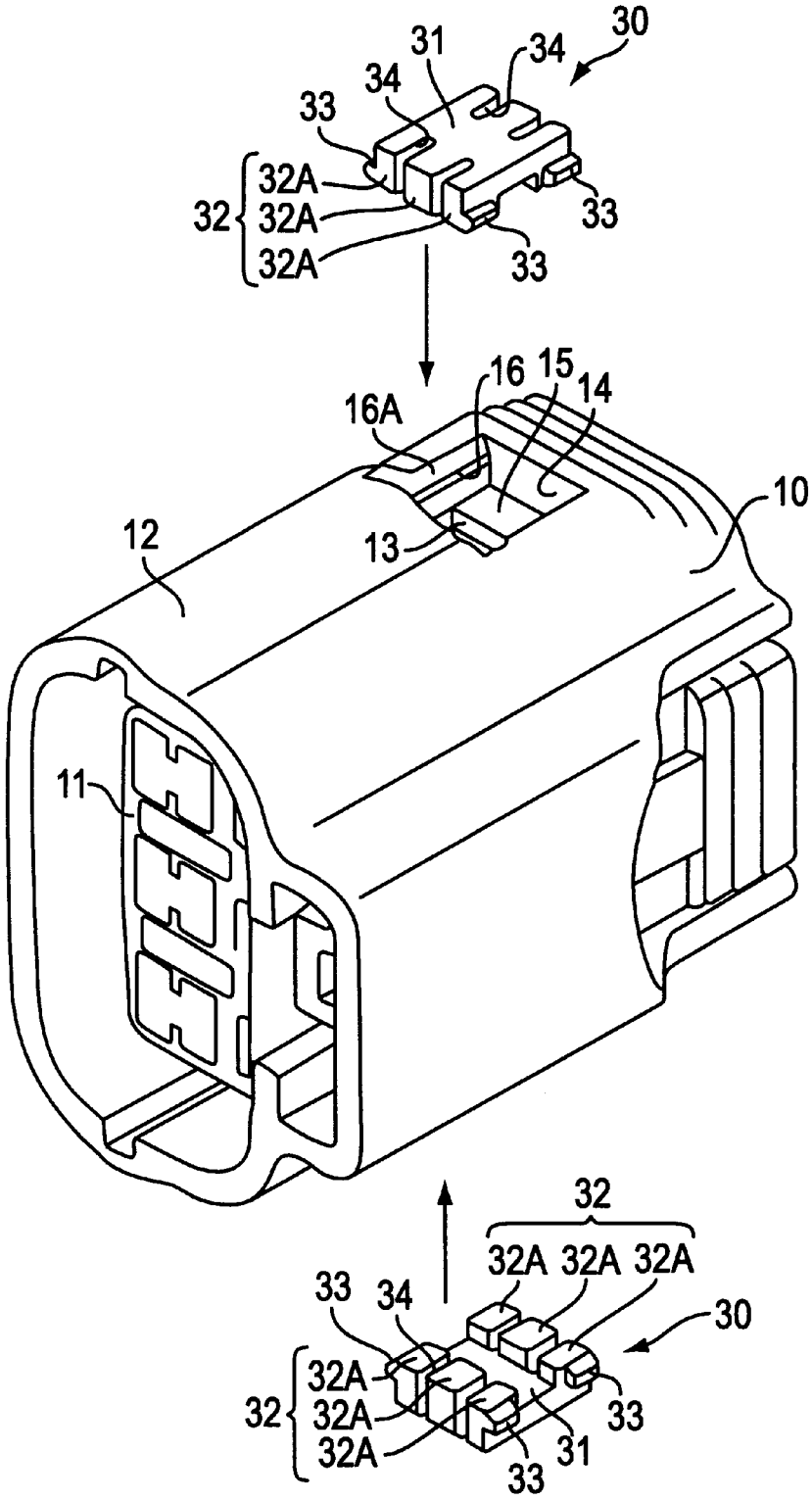
FIG. 1 is a perspective view representing a state prior to installation of the retaining members and the sealing member according to the first embodiment of the invention.
Figure 2:
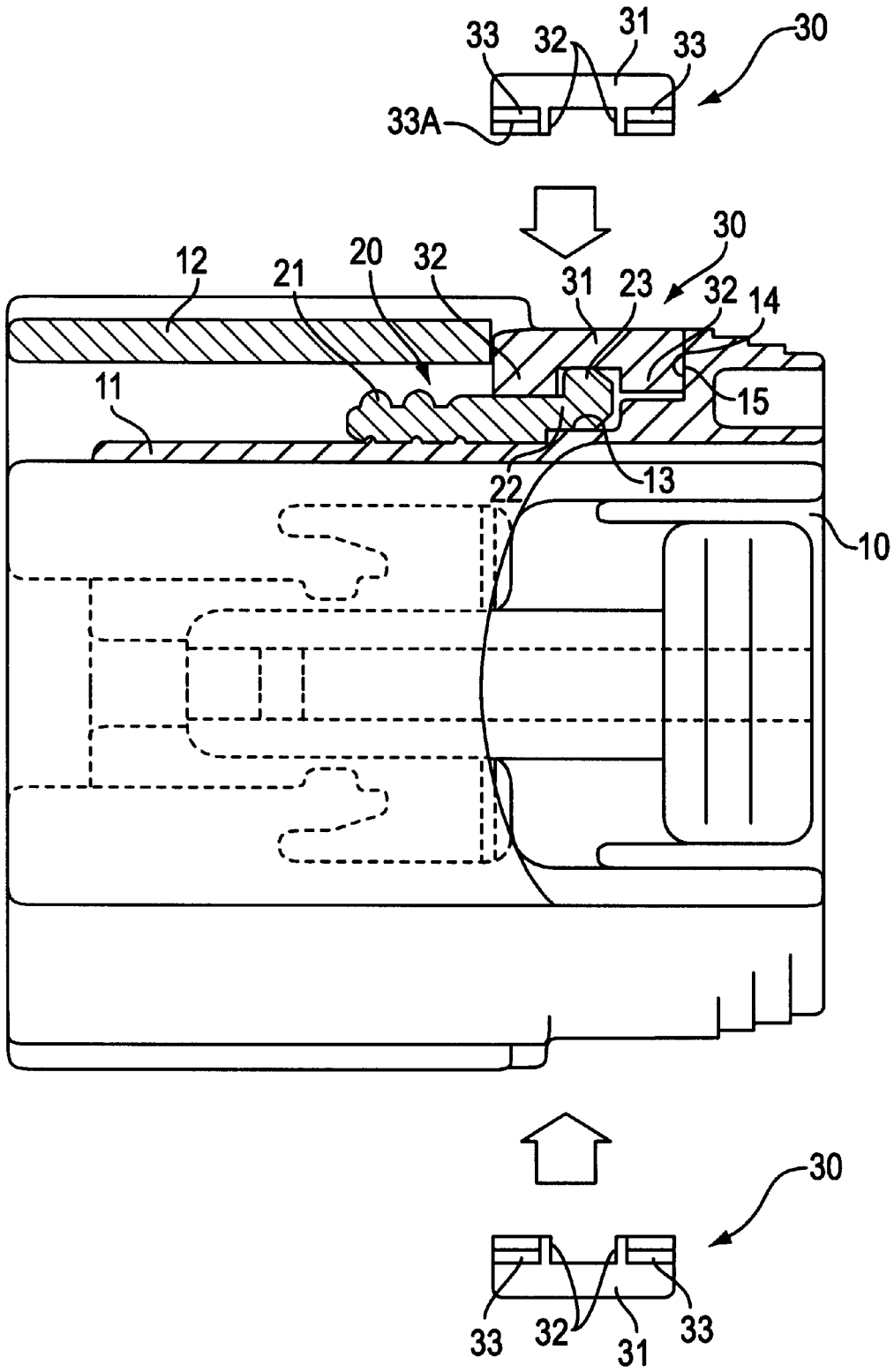
FIG. 2 is a sideview in partial cross-section representing a state in which the sealing member and the retaining members have been installed in the first embodiment of the invention.
Figure 6:
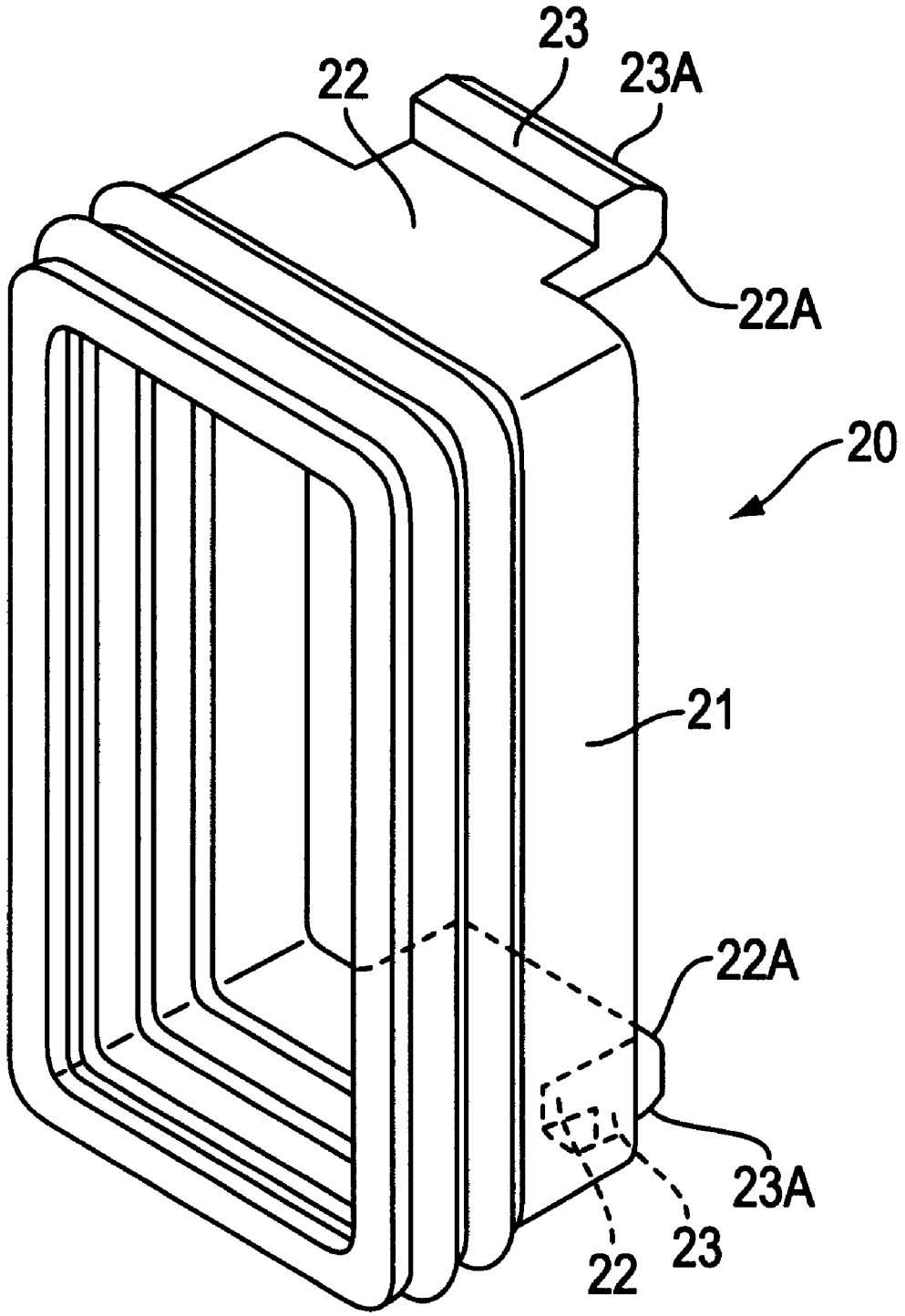
FIG. 6 is a perspective view of the sealing member in accordance with the first embodiment of the invention.

Installation structure of the sealing member 20 is illustrated in detail below, and the sealing member 20 is illustrated in FIG. 6. Sealing member 20 is composed of a rubber material, and includes a ring-type sealing main body 21 which is fitted within the housing main body 11. The sealing member 20 includes protrusions 22 which extend along the longitudinal direction of the housing main body 11 (left and right directions as depicted in FIG. 2) from opposite end portions of the sealing main body 21. The hood part of the above-mentioned male connector housing (not shown) is fitted within the outer circle of the housing main body 11, the sealing main body 21 is elastically deformed by being tightly clamped between the housing main body 11 and the hood part. Therefore, the gap between the hood part of the male housing and the housing main body 11 of the female connector housing is made water-proof.

The protrusions 22 extend straight along the outer face of the housing main body 11, and retaining portions 23, which extend at substantially right angles to the direction of installation of the sealing member 20, are formed at the free ends of the respective protrusions 22. Chamfers 23A for preventing hooking on the inner circle of the guide pipe part 12 at the time of installing the sealing member 20 are provided on the outer end edges of the retaining portions 23. Furthermore, chamfers 22A for preventing hooking on the guide channels 13, mentioned later, at the time of installing the sealing members 20 are provided on the inner end edges of the protrusions 22.

Guide channels 13 for aiding in the installation of the sealing member 20 are formed in the female connector housing 10. The guide channels 13 are open to the inmost edge face of the guide pipe part 12 and are formed in a continuous plane at the outer circle of the housing main body 11. When the sealing member 20 is installed on the housing main body 11, the protrusions 22 and the retaining portions 23 are designed to be positioned in the guide channels 13. The guide channels 13 are sized so as to receive the protrusions 22 and the retaining portions 23 without causing bending deformation.

The above-mentioned guide channels 13 are open at one end to the outer face the female connector housing 10, and these openings provide installation openings 14 for retaining members 30. The installation openings 14 extend over a region corresponding to the retaining portions 23. The end faces of right angled parts of the retaining portions 23 in the installation openings 14 abut stops 15, and when the retaining members 30 are installed in their normal position, the downwardly extending parts 32 nearly abut against the stops 15 (FIG. 2).

Figure 4:
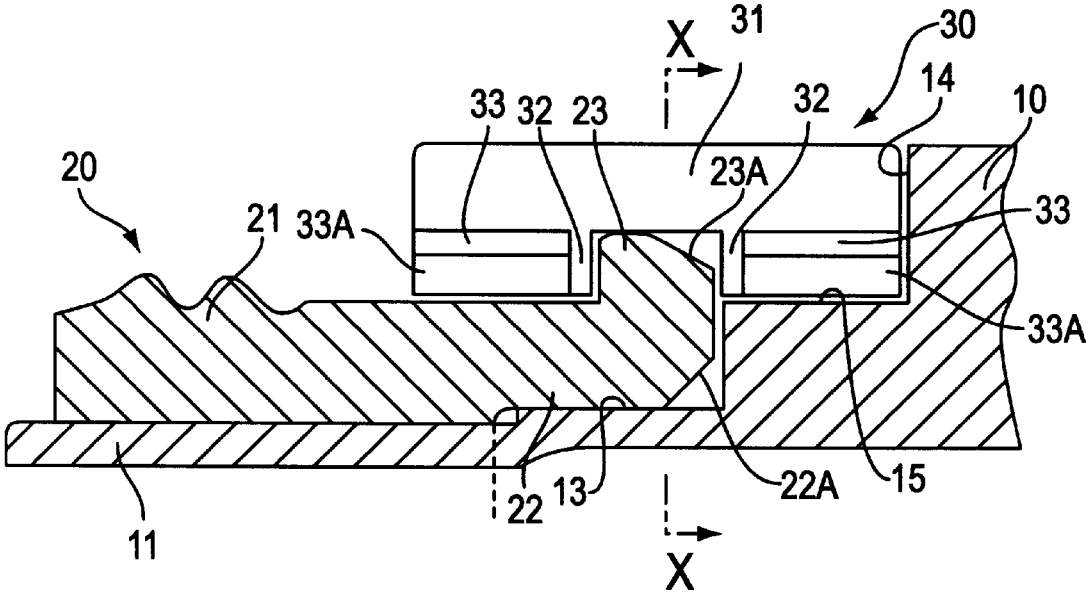
FIG. 4 is an enlarged partial cross-sectional view depicting the engagement between the sealing members and the retaining members.

The height of the stops 15 is set to be at about the same level as the outer faces of the protrusions 22 (see FIGS. 2 and 4). Furthermore, the width (from left to right as seen in FIG. 2) of the installation opening 14 at both sides of the retaining portions 23 is set to have substantially the same dimension. Thus, if the retaining members 30 are installed in a reverse orientation from that shown in FIG. 2, they are designed to be installed in the same manner.

Figure 3:
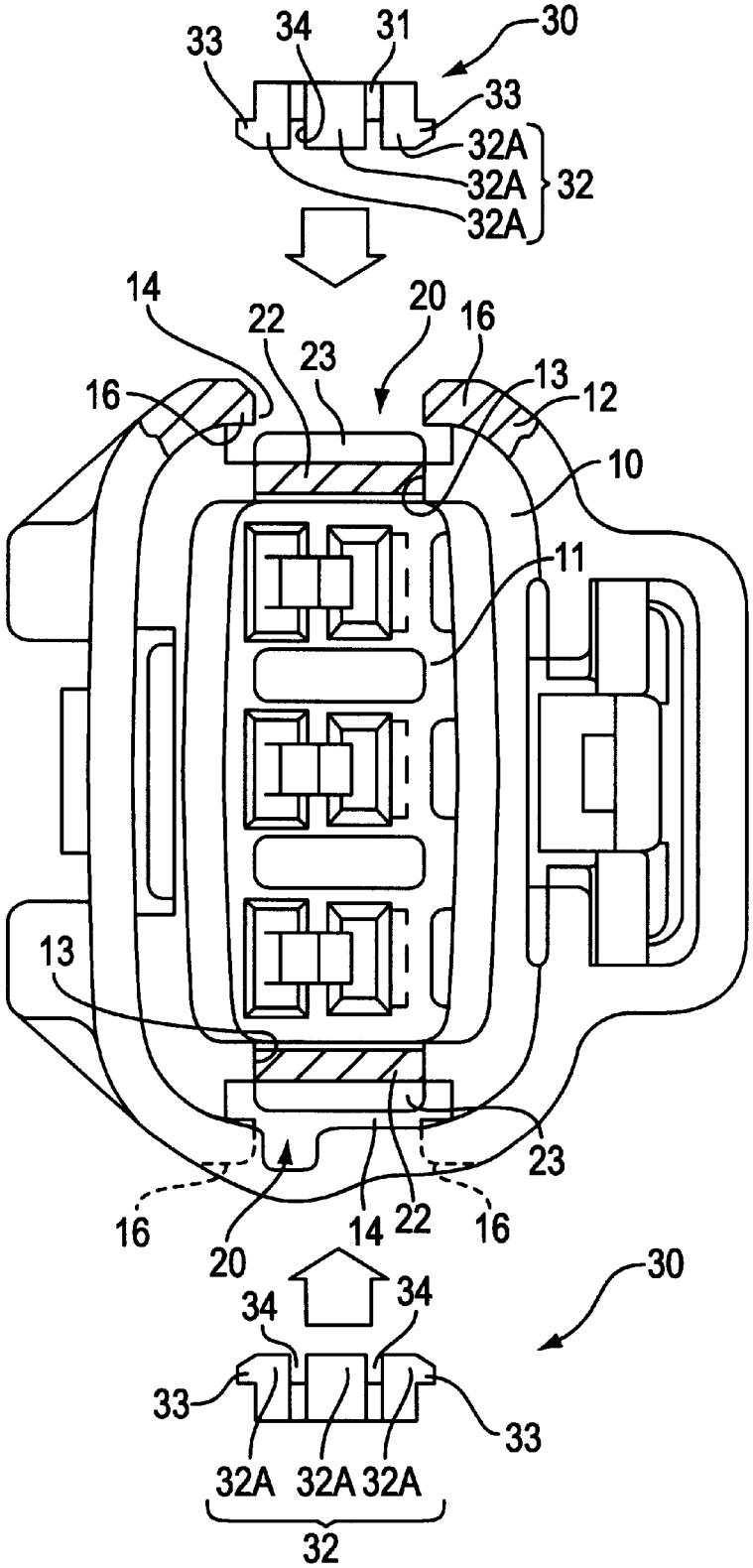
FIG. 3 is a front view in partial cross-section depicting installation of the sealing member and the retaining members in accordance with the first embodiment of the invention.

Further, a pair of the removal-stopping protrusions 16 are formed on both the left and right inner walls of the installation openings 14(FIG. 3), and the removal of the retaining members 30 from the installation openings 14 is inhibited by hooking the hooks 33 of the retaining members 30 on the removal-stopping protrusions 16. A pair of removal-stopping protrusions 16 is symmetrically positioned on opposite sides of the installation opening 14 as shown in FIG. 3, and even if the retaining members 30 are installed to a reverse orientation to that shown in FIG. 3, they are designed to be installed in the same manner as long as the hooks 33 are aligned with removal-stopping protrusions 16. Further, the tapered insertion slopes 16A are formed at the upper rims of edges of the removal-stopping protrusions 16 for smooth installation of the retaining members 30.

Figure 7:
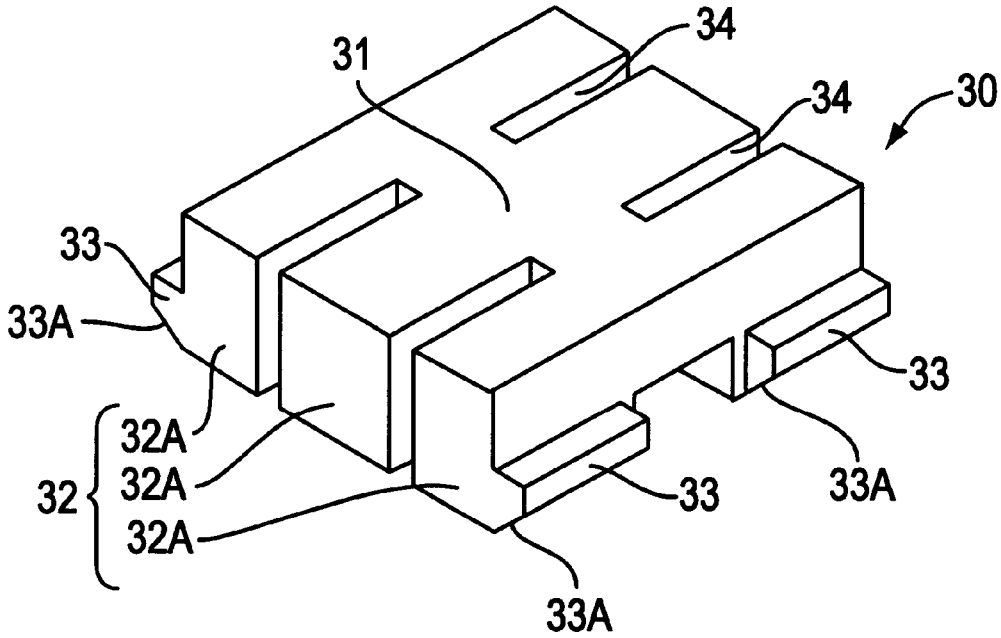
FIG. 7 is a perspective view of the retaining member in accordance with the first embodiment of the invention.

The retaining members 30 are illustrated in FIG. 7, as well as in FIGS. 2–5. The retaining members 30 are formed of a rectangular plate type main body part 31 to extend over the opening region of the installation opening 14. A pair of protrusions 32 extend downwardly along the front and back edges of the main body parts 31, and hooks 33 protrude from both left and right faces of the protrusions 32. Two slits 34 are cut in both the front and back rims of the main body part 31. The respective protrusions 32 are divided into three protruding pieces 32A by the slits 34, and both sides of the protruding pieces 32A having the hooks 33 are design to be elastically deformed inwardly while narrowing the slits 34. Further chamfers 33A are formed at the outer edges of the hooks 33 to provide smooth installation of the retaining members within the installation openings 14. The retaining members 30 are symmetrically shaped in the front to back direction as well as in the left to right direction. Therefore, even if the retaining members 30 are reversed along the outer faces of the main body parts 31, they are designed to be installed in the same manner regardless of orientation.

The installation of the sealing member 20 in accordance with the present invention will now be described. Installation of the sealing member 20 is carried out prior to the installation of the retaining members 30, and the sealing main body 21 is fitted onto the housing main body 11 from the forward end of the female connector housing 10 with the retaining portions 23 being inserted first. As the sealing main body 21 proceeds inwardly, the protrusions 22 and the retaining portions 23 are introduced in the guide channels 13.

The protrusions 22 and the retaining portions 23 are smoothly stored in the guide channels 13 without elastic bending during insertion. After completion of the outer fitting of the sealing member 20, the inner faces of the protrusions 22 closely contact the bottom face of the guide channel 13, and the edge faces of the protrusions 22 nearly engage the inmost end face of the guide channel 13 (FIG. 2). Further, the retaining portions 23 reside within the installation opening 14 in a manner such that they protrude above the level of the stops 15. At this time, both the front and back sides (the left and right sides as seen in FIG. 2) of the retaining portions 23 are spaced equally from the opposite sides of the installation opening 14.

Figure 5:
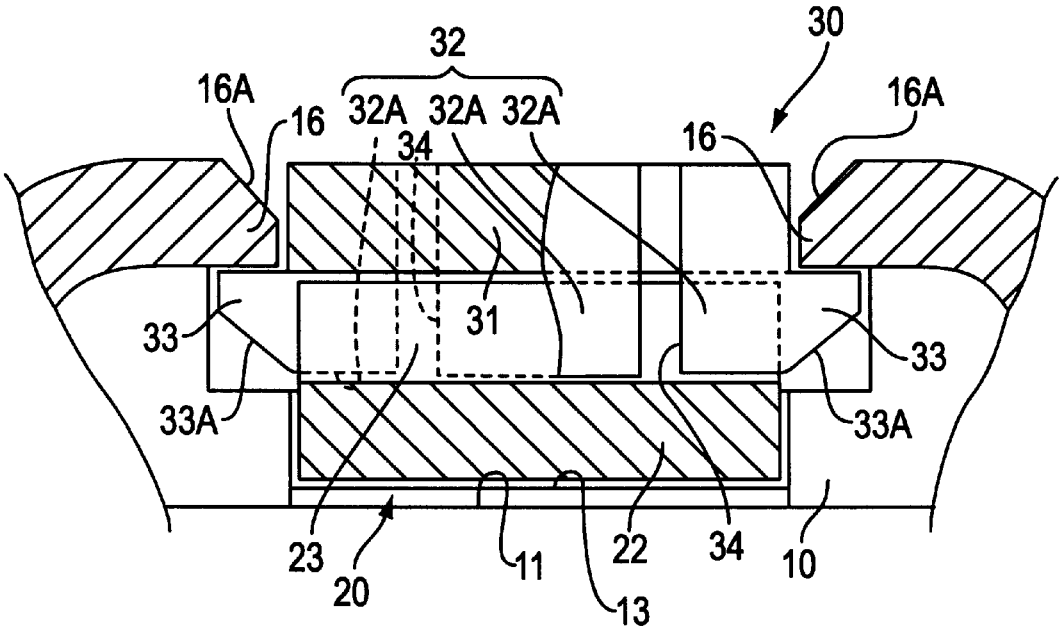
FIG. 5 is an enlarged cross-sectional view taken along the lines X—X of FIG. 4.

The retaining members 30 are next installed in the installation opening 14 by being inserted in a direction such that the hooks 33 correspond with the removal-stopping protrusions 16. During installation, the hooks 33 interfere with the removal-stopping protrusions 16, but the hooks 33 escape inside and smoothly pass through the removal-stopping protrusions 16, by bending both sides of the protrusions 32A through engagement of chamfers 33A with insertion slopes 16A. When the retaining members 30 are fully inserted to the normal installation position, the protruding pieces 32A elastically restore, and the hooks 33 hook on the removal-stopping protrusions 16 from inside, as shown in FIG. 5, and accordingly the removal of the retaining members 30 from the female connector housing 10 is inhibited.

As shown in FIG. 4, the hooks 33 extend on both sides of the protrusions 23 and substantially prevent movement in the back and forth directions (left and right as seen in FIGS. 2 and 4). Therefore, even if a force is applied in the removal direction to the sealing member 20, the protrusions 23 contact the left protrusion 32 in FIG. 2, and movement of the sealing member 20 in the removal direction is prevented.

As described above, according to the present invention, the retaining members 30 for retaining the sealing member 20 in the installation state are formed as separate parts from the female connector housing 10. Therefore, when the sealing member 20 is installed within the female connector housing 10, the protrusions 22 and the retaining portions 23 are not deformed. That is, resistance during the installation is substantially reduced without causing elastic bending of the protrusions 22 and the retaining portions 23 as the installation of the sealing member 20 is carried out.

Further, since the protrusions 22 on the sealing members 20 and the hooks 33 are respectively and symmetrically formed in the retaining members 30, the retaining members 30 can be installed, regardless of orientation, as long as hooks 33 are aligned with the removal stopping protrusions, and the sealing member 20 will be kept in a state in which removal is inhibited. Therefore, sequential operation from the process for supplying the retaining members 30 to the female connector housing 10 until the installation of the retaining members 30 on the female connector housing 10 can be carried out by an automatic machine.

Further, any tendency of the retaining members 30 to be excessively displaced beyond the normal installation position, resulting in excessive squeezing of the protrusions 22, is regulated by abutment of the protrusions 32 of the rear side (the right side in FIGS. 2 and 4) of the retaining elements 30 on the stops 15. Accordingly, there is no fear that the protrusions 22 will be unnecessarily deformed by squeezing by the protrusions 32 at the front side. Therefore, deformation of the sealing main body 21 caused by the bending of the protrusions 22 which could reduce proper sealing, is prevented.

Further, when the sealing member 20 shifts toward the removal direction, the retaining portions 23 are obliquely deformed rearwardly (right side in FIG. 2) by engagement of the base edge part of the retaining portions 23 on the sealing main body 21 at the fore side (left side in FIG. 2), but the deformation of the retaining portions 23 is designed to be controlled by the protrusions 32. Thus according to the present invention, as the protrusions 32 of the retaining members 30 contact the retaining portions 23 from the back side in the removal direction of the sealing member, the removal regulation effect of the retaining portions 23 by the retaining members 30 is enhanced, and the removal of the sealing member 20 can be prevented.

The present invention is not limited to the preferred embodiment of the invention illustrated by the description and figures of the drawings described above. The present invention contemplates various modifications that can be practiced within the scope of the present invention in addition to the following.

(1) Two retaining members 30 are disclosed in the preferred embodiment described above, but the number of retaining members may be one, two, three, or more.

(2) In addition to the preferred embodiment described above, the retaining members 30 may be positioned at a temporary hooking position permitting the installation of the sealing members, and at a normal hooking position engaging between the sealing member and the female connector housing. As the retaining member 30 is fixed with the female connector housing in this manner before the installation of the sealing member, assembly during the time of transportation and the like becomes easy, and as the retaining members 30 can be moved to the retaining position immediately after the installation of the sealing members, the installation is facilitated.

(3) In the preferred embodiment described above, the sealing member 20 is designed to be positioned between an inner housing part and an outer housing part of the female connector housing. However, the present invention can also be applied to a case in which the sealing members are positioned between the end faces of a male connector housing and a female connector housing.

(4) In the preferred embodiment described above, the hooks 33 are symmetrically disposed on the left and right sides of the retaining members 30. According to another embodiment of the present invention, the hooks may be disposed unsymmetrically and the protrusions may be installed unsymmetrically, or only toward the forward side of the guide channels.

(5) According to the preferred embodiment described above, the retaining portions 33 are formed as protrusions. However, in accordance with another aspect of the present invention, the form of the retaining portion is not limited to protrusions but may be formed in the shape of an aperture.

(6) According to the preferred embodiment described above, the retaining portions are engaged by both sides of the hooks of the retaining members. However, in accordance with another aspect of the present invention, the retaining members may engage with faces on the retaining portions which only inhibit movement in the removal direction.

(7) In the preferred embodiment described above, the retaining members are prevented from being excessively squeezed past the normal installation position by the use of stops, but according to another aspect of the present invention, the stops are not always necessary.

Although the invention has been described with reference to particular means, materials, and embodiments, it is to be understood that the invention is not limited to the particulars disclosed and extends to all equivalents within the scope of the claims.

The present disclosure relates to subject matter contained in priority Japanese Application No. HEI-9-011599, filed on Jan. 24, 1997, which is herein expressly incorporated by reference in its entirety.

What is claimed:

1. A water-proof connector comprising, at least one connector housing, a sealing member having at least one retaining portion formed thereon, at least one retaining member adapted to be installed on the connector housing to engage said at least one retaining portion to regulate removal of the sealing member from the connector housing, wherein said at least one retaining member is formed separately from said at least one connector housing;

said at least one retaining portion of said sealing member being engaged with said at least one retaining member; and, guide channels formed in said at least one connector housing for inserting said at least one retaining portion to a position for engaging with said at least one retaining member, whereby a water-proof connector is formed wherein said sealing member is adapted to be installed in one connector housing of a pair of connector housings that can be fitted together, such that both connector housings are adapted to be sealed by said sealing member.

2. A water-proof connector according to claim 1, wherein said at least one retaining member further comprises hooks for engagement with said at least one connector housing, and said at least one retaining member is configured so that said at least one retaining member can be installed in said at least one connector housing regardless of orientation.

3. A water-proof connector according to claim 1, characterized in that said at least one retaining portion is formed to extend perpendicularly to the removal direction of said sealing member, and two protrusions are formed on each said retaining member to abut against the retaining portions of the sealing member in a manner to preclude movement of the sealing member in both the installation and the removal directions.

4. A water-proof connector according to claim 1, further comprising stops formed on the housing for engagement by said at least one retaining member to prevent displacement beyond the normal position of installation.

5. A water-proof connector according to claim 1, wherein said at least one connector housing further comprises at least one installation opening for receiving said at least one retaining member.

6. A water-proof connector according to claim 1, wherein said at least one retaining portion is formed on a protrusion on said sealing member.

7. A water-proof connector according to claim 1, further comprising slots formed in at least one end of said at least one retaining member to permit inward deflection of said hooks to permit installation on the connector housing.

8. A water-proof connector according to claim 2, wherein said hooks are formed on opposite sides of said at least one retaining member.

9. A water-proof connector according to claim 8, wherein said at least one connector housing further comprises at least one installation opening for receiving said at least one retaining member, and wherein said hooks are retained in said at least one installation opening.

10. A water-proof connector according to claim 9, wherein said hooks formed on opposite sides of said at least one retaining member include chamfered edges to assist in installation in said installation opening.

* * * * *

UNITED STATES PATENT AND TRADEMARK OFFICE

CERTIFICATE OF CORRECTION

PATENT NO. : 6,126,468
DATED : October 3, 2000
INVENTOR(S) : Y. Matsushita et al.

It is certified that error appears in the above-identified patent and that said Letters Patent is hereby corrected as shown below:

Column 7,
Line 36, "adapted" should be -- configured --.
Line 37, "to engage" should be -- subsequent to installation of said sealing member within said housing, said at least one retaining member including a recess that receives --.

Column 8,
Lines 8-11, after "housing" delete ", and said at least one retaining member is configured so that said at least one retaining member can be installed in said at least one connector housing regardless of orientation".
Lines 31-32, "claim 1, further comprising slots" should be -- claim 2, further comprising slits --.

The following new claims 11-16 were omitted and should be included:

-- 11. A water-proof connector according to claim 1, wherein said at least one retaining member is configured so that said at least one retaining member can be installed in said at least one connector housing regardless of orientation.

12. A water-proof connector comprising:

at least one connector housing;

a sealing member having at least one retaining portion formed thereon;

at least one retaining member configured to be installed on the connector housing to engage said at least one retaining portion to regulate removal of the sealing member from the connector housing, wherein said at least one retaining member is formed separately from said at least one connector housing;

said at least one retaining portion of said sealing member being engaged with said at least one retaining member; and, guide channels formed in said at least one connector housing for inserting said at least one retaining portion to a position for engaging with said at least one retaining member;

wherein said at least on retaining member further comprises hooks for engagement with said at least one connector housing, and said at least one retaining member is configured so that said at least one retaining member can be installed in said at least one connector housing regardless of orientation;

whereby a water-proof connector is formed wherein said sealing member is adapted to be installed in one connector housing of a pair of connector housings that can be fitted together, such that both connector housings are adapted to be sealed by said sealing member.

It is certified that error appears in the above-identified patent and that said Letters Patent is hereby corrected as shown below:

13. A water-proof connector according to claim 12, wherein said hooks are formed on opposite sides of said at least one retaining member.

14. A water-proof connector according to claim 13, wherein said at least one connector housing further comprises at least one installation opening for receiving said at least one retaining member, and wherein said hooks are retained in said at least one installation opening.

15. A water-proof connector according to claim 14, wherein said hooks formed on opposite sides of said at least one retaining member include chamfered edges to assist in installation in said installation opening.

16. A water-proof connector comprising, at least one connector housing, a sealing member having at least one retaining portion formed thereon, wherein said at least one retaining portion is formed on a protrusion on said sealing member;

at least one retaining member configured to be installed on the connector housing to engage said at least one retaining portion to regulate removal of the sealing member from the connector housing, wherein said at least one retaining member is formed separately from said at least one connector housing;

said at least one retaining portion of said sealing member being engaged with said at least one retaining member; and, guide channels formed in said at least one connector housing for inserting said at least one retaining portion to a position for engaging with said at least one retaining member,

UNITED STATES PATENT AND TRADEMARK OFFICE

CERTIFICATE OF CORRECTION

PATENT NO. : 6,126,468
DATED : October 3, 2000
INVENTOR(S) : Y. Matsushita et al.

It is certified that error appears in the above-identified patent and that said Letters Patent is hereby corrected as shown below:

whereby a water-proof connector is formed wherein said sealing member is adapted to be installed in one connector housing of a pair of connector housings that can be fitted together, such that both connector housings are adapted to be sealed by said sealing member. --

Signed and Sealed this

Twenty-fifth Day of December, 2001

*Attest:*

*Attesting Officer*

JAMES E. ROGAN
*Director of the United States Patent and Trademark Office*